US008057279B2

(12) United States Patent
Connelly

(10) Patent No.: US 8,057,279 B2
(45) Date of Patent: Nov. 15, 2011

(54) ABRASIVE BLASTING SYSTEM WITH REMOTE FLOW CONTROL AND METHOD

(76) Inventor: William J. Connelly, Irving, TX (US)

( * ) Notice: Subject to any disclaimer, the term of this patent is extended or adjusted under 35 U.S.C. 154(b) by 716 days.

(21) Appl. No.: 12/120,626

(22) Filed: May 14, 2008

(65) Prior Publication Data

US 2008/0287039 A1 Nov. 20, 2008

Related U.S. Application Data

(60) Provisional application No. 60/938,493, filed on May 17, 2007.

(51) Int. Cl.
*B24B 49/00* (2006.01)
*B24B 51/00* (2006.01)
*B24C 3/02* (2006.01)

(52) U.S. Cl. ..... 451/2; 451/5; 451/39; 451/91

(58) Field of Classification Search ..... 451/2, 5, 451/39, 40, 90, 91, 92, 101
See application file for complete search history.

(56) References Cited

U.S. PATENT DOCUMENTS

| | | | | |
|---|---|---|---|---|
| 2,261,565 | A | 11/1941 | Roselle | |
| 4,646,482 | A | 3/1987 | Chitjian | |
| 5,319,946 | A * | 6/1994 | Manificat | 62/342 |
| 5,591,064 | A | 1/1997 | Spears, Jr. | |
| 6,244,940 | B1 * | 6/2001 | Boulton et al. | 451/95 |
| 6,607,175 | B1 | 8/2003 | Nguyen et al. | |
| 7,134,945 | B2 | 11/2006 | Alexander | |
| 2003/0224704 | A1 * | 12/2003 | Shank | 451/38 |
| 2005/0003747 | A1 * | 1/2005 | Dore | 451/90 |
| 2006/0128282 | A1 * | 6/2006 | Grechishkin | 451/75 |
| 2006/0178092 | A1 * | 8/2006 | Spivak et al. | 451/99 |
| 2007/0218816 | A1 * | 9/2007 | Shimizu et al. | 451/88 |

FOREIGN PATENT DOCUMENTS

GB 2230485 10/1990

OTHER PUBLICATIONS

Thompson Valve II Product Information Sheet, Wheelabrator Group, pp. 1-2, earliest known date—Apr. 18, 2008.

* cited by examiner

*Primary Examiner* — Timothy V Eley
(74) *Attorney, Agent, or Firm* — Grady K. Bergen; Griggs Bergen LLP

(57) ABSTRACT

A particulate blasting apparatus includes a blast vessel having an interior for storing abrasive particulate. The blast vessel has an inlet for introducing a pressurized gas into the interior of the blast vessel and an outlet for allowing the passage of the pressurized gas and particulate. A flexible blast hose is coupled at one end to the outlet for directing particulate flow from the outlet and a blast nozzle is coupled to an opposite end of the blast hose. A metering valve regulates different amounts of particulate flow from the blast vessel through the outlet. A flow actuator is coupled to the metering valve for actuating the metering valve. A controller associated with the blast nozzle in communication with the actuator controls the actuator from the blast nozzle during blasting operations. The blasting apparatus may be used as part of a blasting system that includes a compressor unit for providing the pressurized gas. A method of blasting an area is achieved by controlling the amount of particulate provided to the blast nozzle from the blast nozzle through the controller associated with the blast nozzle while pressurized gas is flowing through the blast nozzle and directing a particulate flow from the blast nozzle to the area.

20 Claims, 7 Drawing Sheets

ABRASIVE BLASTING SYSTEM WITH REMOTE FLOW CONTROL AND METHOD

CROSS-REFERENCE TO RELATED APPLICATIONS

This application claims the benefit of U.S. Provisional Patent Application No. 60/938,493, filed May 17, 2007, which is herein incorporated by reference in its entirety.

BACKGROUND

During blasting operations using prior art abrasive blasting equipment, the operator directs a mixture of pressurized air and particulate abrasive material, such as soda, sand, etc., through a nozzle to the area requiring cleaning or blasting. The abrasive particulate is stored in a blast pot containing the particulate that is pressurized with air. The nozzle is typically connected to the blast pot through a length of flexible hose so that the nozzle may be used at various distances that are remote from the blast pot.

Prior art blasting equipment utilizes an on/off control so that the blast stream can be stopped or started with no variation in the amount of particulate flow or pressure from the blast pot. In order to regulate the flow of particulate, the operator must stop the blasting operation and return to the blast pot so that the flow setting of the blast pot can be manually adjusted. The operator must then return to the blast nozzle, test the particulate flow from the nozzle and determine whether the particulate flow is adequate or optimal. If the flow is not optimal, the operator must return to the blast pot and continue this process until the proper particulate flow is achieved. As can be seen, this is an inconvenient and time consuming process. Furthermore, during a job, different degrees of particulate flow may be required or necessary at any given time to perform the blasting operation. In some instances, the particulate flow may be optimal for certain areas, but too low or too high for others. In many instances, proper optimization may not be seriously pursued by the operator because of the inconvenience of adjusting the abrasive flow. This may result in abrasive being wasted because it is either insufficient or excessive for the particular area being blasted or it provides an inadequate blasting job.

Accordingly, what is therefore needed is a means for abrasive blasting wherein the amount of blasting media can be controlled remotely from the blast pot and during the blasting operation to overcome these shortcomings.

BRIEF DESCRIPTION OF THE DRAWINGS

For a more complete understanding of the present invention, and the advantages thereof, reference is now made to the following descriptions taken in conjunction with the accompanying figures, in which.

DETAILED DESCRIPTION

Figure 1:
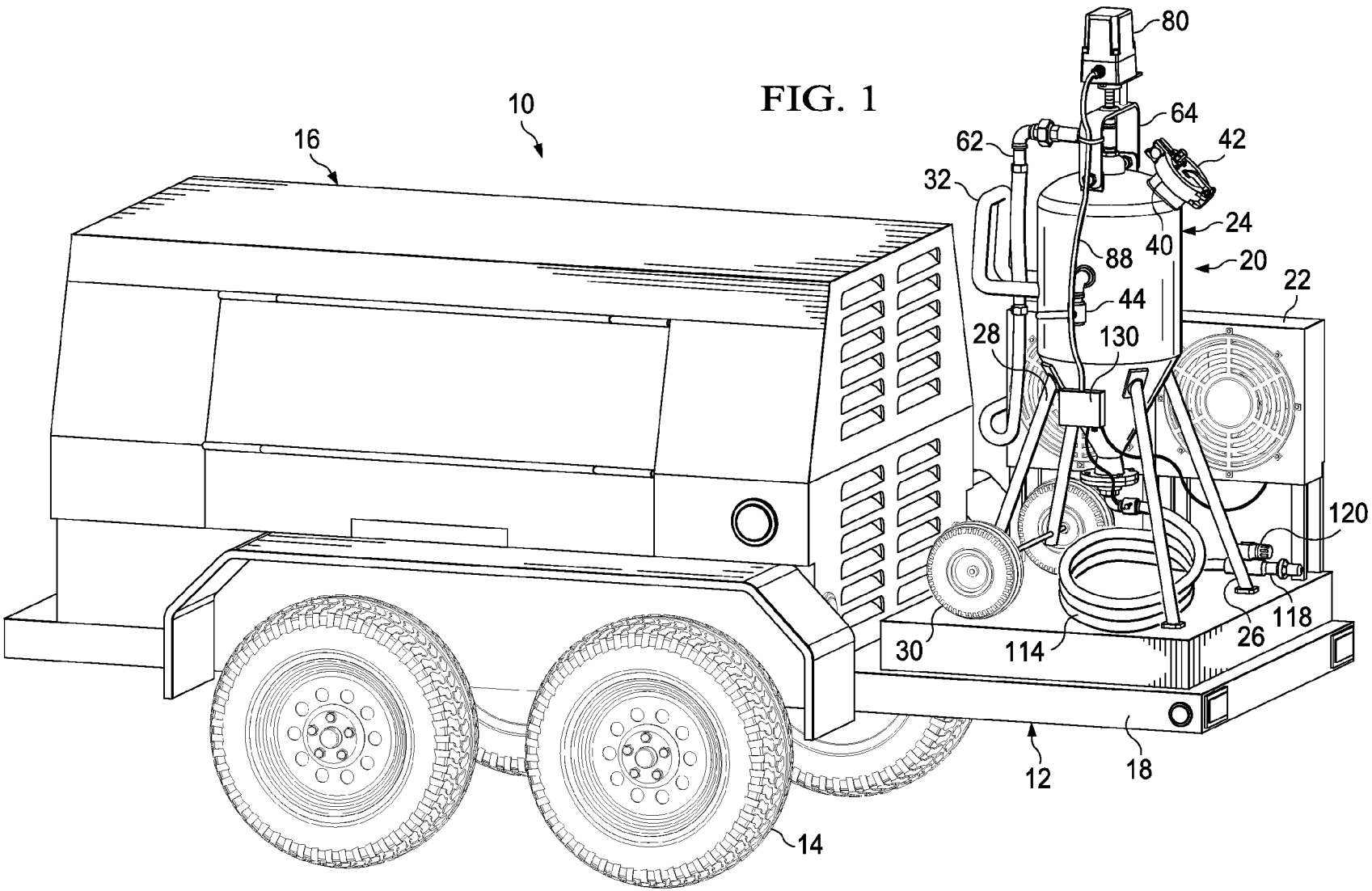
FIG. 1 is a side perspective view of a mobile abrasive particulate blasting system employing a blasting apparatus with a remote abrasive control in accordance with the invention.

Referring to FIG. 1, an abrasive particulate blasting system 10 is shown. The blasting system 10 is shown as a mobile system that includes a trailer or frame 12 mounted on wheels 14, so that the system may be readily transported to different locations. The system 10 may be a stationary system, as well. A compressor unit 16 for providing a pressurized gas is mounted or carried on the frame 12. The pressurized gas is typically air, although other gases, such as nitrogen, carbon dioxide, etc. or mixture of gases, may also be used with the system 10. Although the following description references air as the pressurized gas, it will be understood that other gases or gas mixtures may be used.

The compressor unit 16 may be electrically powered from an outside power source or powered by a combustible fuel engine, such as diesel or gasoline. An electrical generator and/or battery (not shown) may be provided with those units or systems where combustible fuel engines are employed for supplying electrical power to the compressor unit 16 and/or other components of the system 10, where electrical power is required.

In the embodiment shown, a blast unit platform 18 is provided with the frame 12 for supporting or carrying a blast unit 20 of the system 10. A dryer unit 22 may be provided with the system 10 and is shown mounted on a blast unit platform 18. Because ambient air is typically used as the gas pressurized by the compressor 16, it may contain moisture that can be detrimental to the system and materials used in the blasting operation. The dryer 22, which is shown as a twin-fan air cooler with a moisture separator, facilitates cooling of the air and removal of such moisture from the pressurized air received from the compressor 16.

Figure 2:
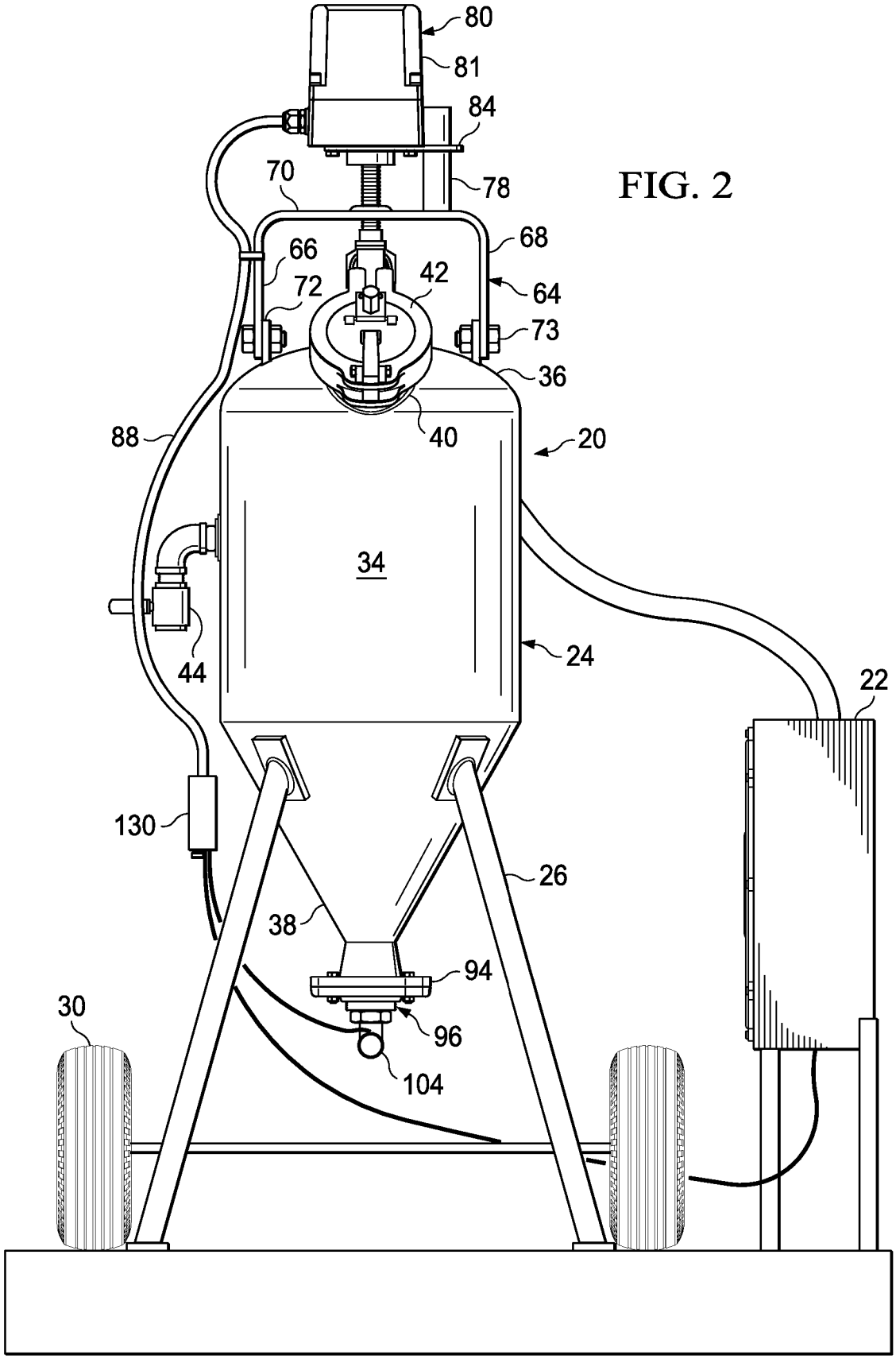
FIG. 2 is a front elevational view of the blasting apparatus of FIG. 1.

The blast unit 20 includes a blast pot or vessel 24 (FIG. 2) that is supported on forward and rearward support members 26, 28 on the platform 18. Wheels 30 may also be provided, as shown mounted to rearward support members 28, for facilitating transport of the blast unit 20. A handle 32 is shown mounted to the blast vessel 24, so that the blast unit may be transported much like a hand truck or dolly. A releasable locking system (not shown) may be used to secure the blast unit 20 to the platform 18.

The blast vessel 24 (FIG. 2) may have a variety of configurations, but in the embodiment shown, the blast vessel 24 has a generally cylindrical midsection 34, a generally hemispherical or inverted dish-shaped upper portion 36 and a generally conical lower section 38. An access port or opening 40 is provided in the wall of the blast vessel 24, for accessing the interior of the vessel and to introduce abrasive particulate used. A cover or closure 42 is provided with the opening 40 to selectively close the opening. The closure 42 may be provided with a seal or seals and a locking mechanism suitable to withstand the high pressures used with the blast unit 22. A pressure relief valve 44 may also be provided with the vessel 24 to facilitate release of the pressurized air within the vessel 24.

Figure 3:
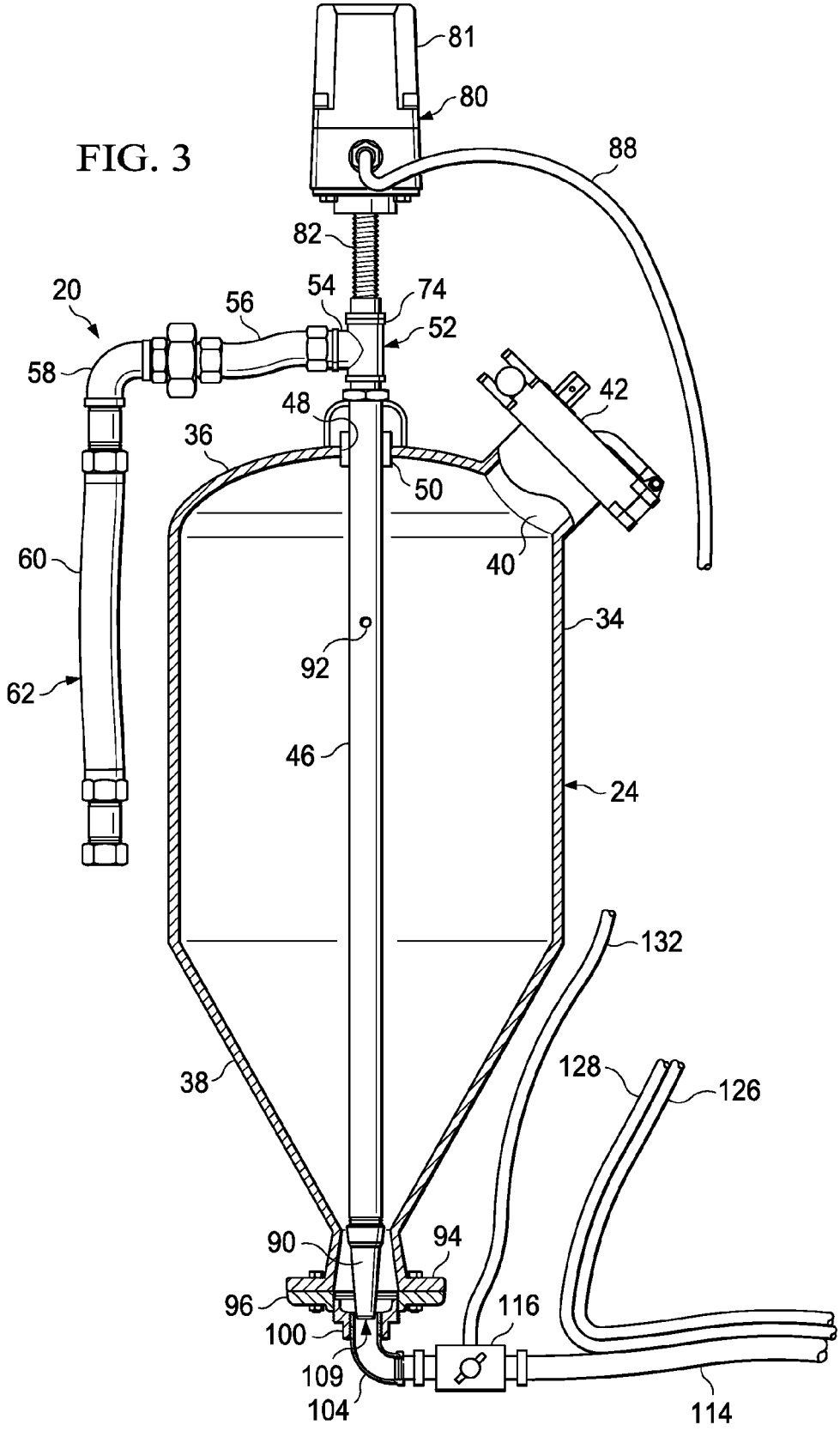
FIG. 3 is cross-sectional elevational side view of the blasting apparatus of FIG. 2, showing internal components of blast vessel of the blasting apparatus.

Referring to FIG. 3, pressurized air or other gas from the compressor 16 is directed into the interior of the blast vessel 24 through an elongated central conduit 46. As shown, the conduit 46 extends from the exterior of the vessel 24 through an opening 48 in the upper portion 36 of the vessel 24. A seal assembly 50 provided in the opening 48 provides a fluid tight seal around the conduit 46 so that the conduit 46 can be moved longitudinally within the opening 48 while preventing the escape of gas during use.

In the embodiment shown, the upper end of the conduit 46 is coupled to a T-fitting 52. A side inlet 54 of the T-fitting 52 is coupled to a length of flexible conduit 56. The flexible conduit 56 is connected through elbow fitting 58 to a vertical length of flexible conduit 60. The flexible conduit 56, elbow 58 and flexible conduit form an inlet conduit 62 of the blast unit 20. Various conduit sections, couplings or fittings may be used to form the inlet conduit 62. The couplings and fittings may facilitate removal and replacement of various lengths of conduit and other components of the inlet conduit 62, if necessary.

Figure 4:
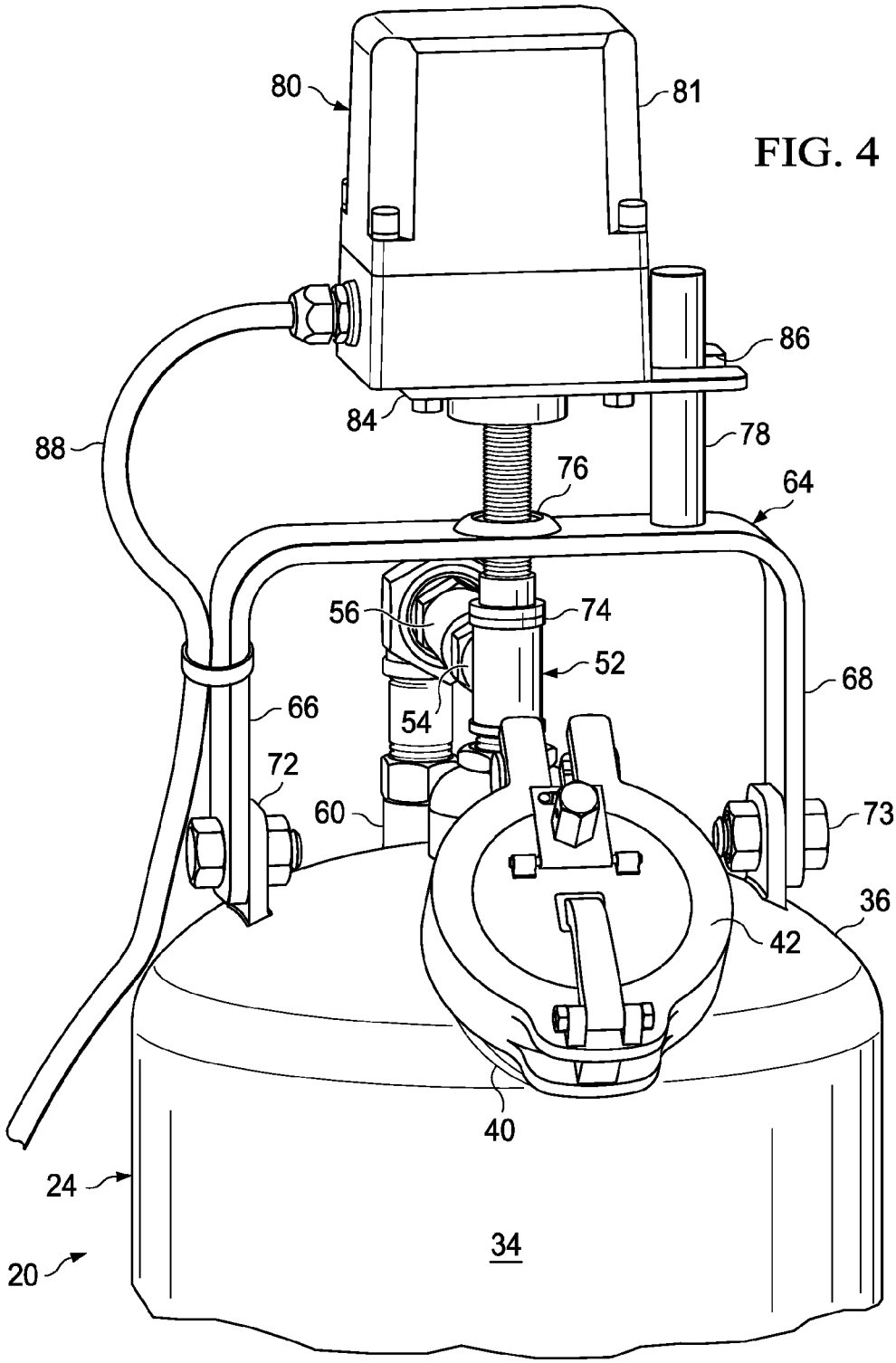
FIG. 4 is an enlarged front perspective view of the upper portion of the blasting apparatus of FIG. 2, showing an actuator of the blasting apparatus.

Referring to FIG. 4, an actuator bracket 64 is mounted to the exterior of the upper portion 36 of the blast vessel 24. The actuator bracket 64 has a generally U-shaped configuration, as shown, having legs 66, 68 joined by a transverse cross member 70. Bracket mounting flanges 72 may be provided, such as by welding, on the upper portion 36 of the vessel 24 for mounting of the bracket 64, such as with bolts or fasteners 73, through the legs 66, 68. The bracket 64 is configured so that the cross member 70 extends over the upper end 74 of the T-fitting 52. The cross member 70 of the bracket 64 is provided with a hole or opening 76 that is centered or aligned directly above the upper end 74 of the T-fitting 52. An upright guide member or post 78 is provided on the bracket 64 and extends vertically from the upper surface of the cross member 70 and is laterally spaced a distance from the opening 76.

A rotary valve actuator 80 is provided with the blast unit 20 and is mounted to the actuator bracket 64. The actuator 80 is provided with an actuator housing 81 for housing the internal components of the actuator 80. As shown in FIG. 4, the actuator 80 rotatably drives an externally, helical threaded drive member 82 that is received within and passes through the opening 76 of the cross member 70. The opening 76 of the cross member 70 is also provided with helical internal threads that correspond to and engage the helical threads of the drive member 82. The lower end of the drive member 82 engages the upper end 74 of the T-fitting 52 so that the drive member 82 rotates freely relative to the T-fitting 52. The upper end 74 of the T-fitting is plugged so that no pressurized air can pass through the upper end 74.

Coupled to the actuator housing 81 is an actuator arm 84. The actuator arm 84 is provided with a guide member receiving portion 86, which may be in the form of an aperture or slot, which engages the guide member 78. The guide member 78 prevents the actuator 80 from rotating relative to the bracket 64 when actuated so that the drive member 82 is rotated and not the actuator housing 81. The guide member 78 allows the actuator 80 to move linearly up and down, however.

Figure 5:
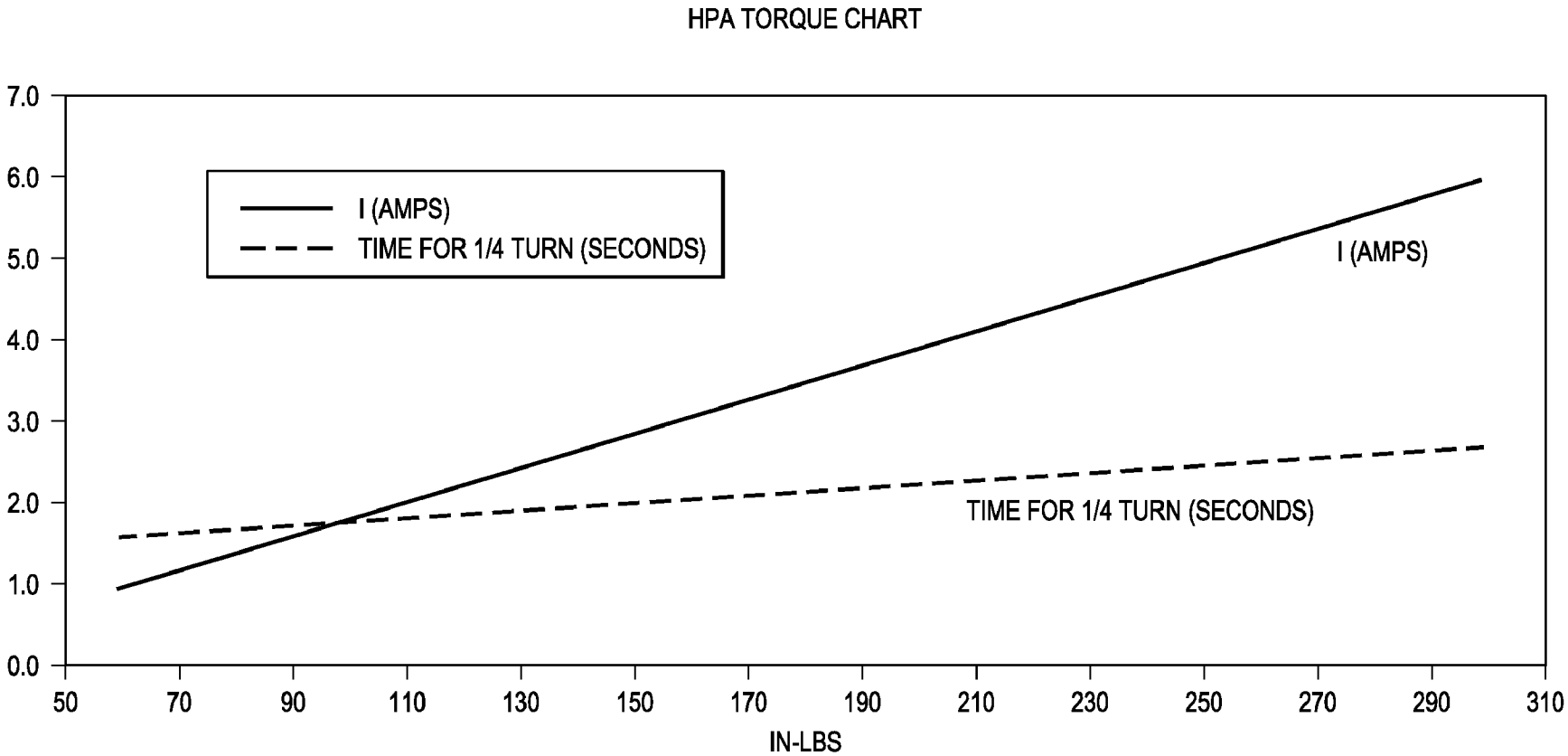
FIG. 5 is a plot of torque versus current and the rate of turning used in an actuator suitable for the blasting apparatus.

In the embodiment shown, the actuator 80 is an electric actuator. In the present embodiment, torque limiting software may be provided with the actuator 80 to prevent damage to the actuator in the case of "hard stops" due to mechanical blockage. This may also limit the amount of torque applied to limit damage to the valves of the blast unit 20 when they are fully seated. A suitable torque is that shown in FIG. 5, with the amount of torque increase with the amount of current supplied. The actuator 80 may use a continuous or digital signal. Power and electrical signals to the actuator are supplied through wiring 88. The actuator 80 may also have a limiter that limits the degree of actuation or number of rotations that are provided to a preselected level. Although the actuator 80 has been shown and described as an electrical rotary actuator, other actuators may be used as well. In some embodiments, a linear actuator may be used to impart a linear motion to actuate valves of the blast unit 20. Additionally, the actuator may be hydraulically, pneumatically or mechanically driven and/or controlled.

As pressurized air is introduced into the interior of the blast vessel 24 through central conduit 46, it is directed downward through the conduit 46 to a nozzle 90 that is coupled to the lower end of the conduit 46, as shown in FIG. 3. The conduit 46 is provided with one or more small holes or apertures 92 near the upper end of the conduit 46. The holes 92 allow the air pressure within the interior of the blast vessel 24 exterior of the conduit 46 and the interior of the conduit to equalize.

Figure 6:
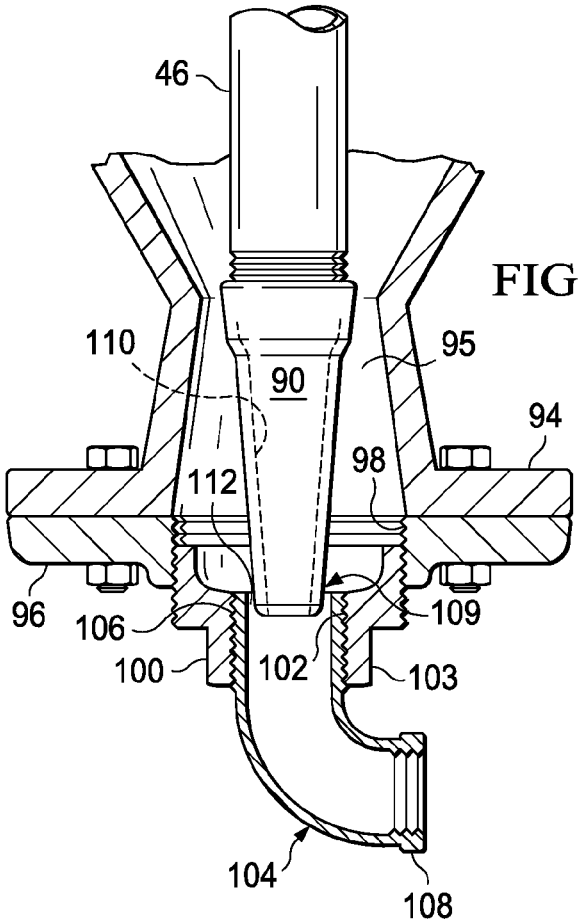
FIG. 6 is a cross-sectional elevational view of one embodiment of a metering valve for use with the blasting apparatus, shown with the metering valve in an open position.
Figure 7:
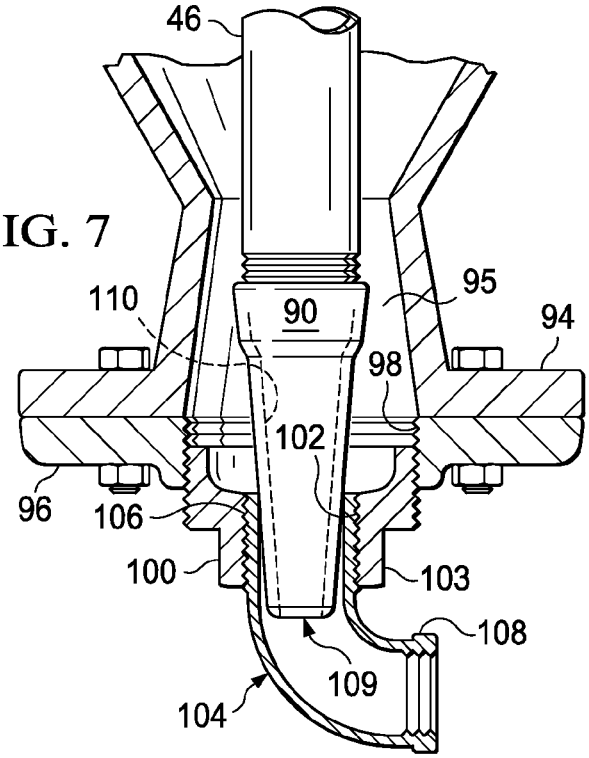
FIG. 7 is a cross-sectional elevation view of the metering valve of FIG. 5, shown with the metering valve in a closed position.

Referring to FIGS. 6 and 7, the lower end of the blast vessel 24 terminates in a flanged end 94 having a central opening 95. Coupled to the flanged end 94 is a flange assembly 96 having an internally threaded central opening 98 to which is threaded an externally threaded union member 100. The union member 100 has an internally threaded central opening 102 and external nut flats 103 to facilitate coupling of the union member 100 with a wrench or other tool. An outlet elbow pipe fitting 104 having an externally threaded upper end 106 engages and is coupled to the central opening 102 of the union member 100. The lower end 108 of the elbow fitting 104 is also threaded to facilitate coupling to other pipe fittings. The opening of the upper end 106 of the elbow fitting 104 forms an outlet opening of the blast vessel 24.

As shown in FIGS. 6 and 7, the nozzle 90 cooperates with the upper end 106 of the elbow pipe 104 to act as a particulate flow valve, which is designated generally at 109. The exterior of the nozzle 90 is tapered in diameter. As an example, the degree of taper (length/diameter) for the exterior of the nozzle 104 may be from about 0.5 to about 1.5. The interior 110 of the nozzle 90 is also tapered in diameter so that the flow within the nozzle 90 is constricted within the interior of the nozzle 90. The degree of taper or constriction within the interior may be the same or different as the exterior of the nozzle 90. The lower end of the nozzle 90 is also smaller in diameter than the outlet 106 so that the lower end of the nozzle 90 can extend a distance within the outlet 106. As shown in FIG. 6, this provides a gap 112 between the exterior of the nozzle 90 and opening of the upper end 106 when the nozzle is in a raised position. As pressurized air flows through the nozzle 90, a venturi effect is created so that the pressure within nozzle is reduced. This causes the abrasive particulate that is stored in the blast vessel 24 to be drawn through the gap 112 and into the elbow 104. By lowering and raising the nozzle 90 relative to the opening 106, the flow of particulate may be increased or decreased.

It should be noted that when a range is presented herein as an example, or as being useful, suitable, etc., it is intended that any and every amount or point within the range, including the end points, is to be considered as having been stated. Furthermore, when the modifier "about" is used with reference to a range or numerical value, it should also be alternately read as to not include this modifier, and when the modifier "about" is not used with reference to a range or numerical value, the range or value should be alternately read as including the modifier "about".

When the nozzle 90 is fully lowered the exterior of the nozzle 90 will seat against the upper end 106 of the fitting 104 so that the gap 112 (FIG. 6) is eliminated, as shown in FIG. 7. This completely cuts off flow of particulate, but allows pressurized air to continue to flow through the nozzle and elbow fitting 104.

Referring to FIG. 3, a length of flexible hose or conduit 114 is coupled to the lower end 108 of the elbow 104 through valve assembly 116. The valve assembly 116 may be an electronically actuated ball valve or other type of valve and is used start and stop the flow of the air and/or particulate/air mixture from the blast unit 20. The flexible hose may have a variety of different lengths depending upon the blasting application, but is typically from about 5 ft. (~1.5 meters) to about 200 ft. (~61 meters) or more. The hoses may be provided in lengths (e.g. 50 ft., 15 meters) that are coupled together. In this way, different hose lengths may be provided.

Figure 8:
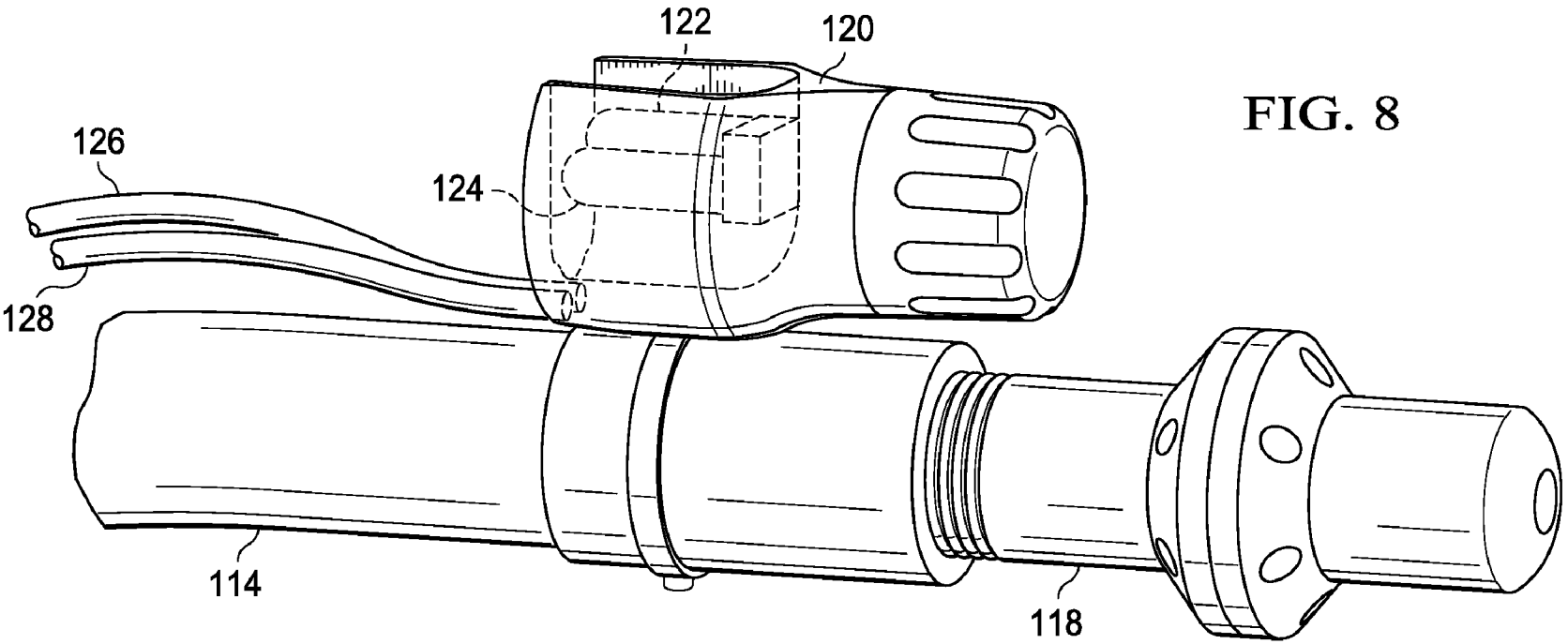
FIG. 8 is a side perspective view of a blast nozzle of the blasting apparatus of FIG. 1, shown with a toggle switch for controlling the blasting apparatus.

Referring to FIG. 8, a blast nozzle 118 is coupled to the other end of the hose 114. The nozzle 118 is configured for providing a particulate blast spray, such as those that are known to those skilled in the art. A controller 120 is mounted to or otherwise provided with the nozzle 118 so that it is in an accessible proximity to the user when handling the nozzle 118. In the embodiment shown, the controller 120 is mounted to the nozzle 118 itself.

A pair of toggle switches 122, 124 is provided with the controller 120. Although the toggle switches 122, 124 are shown in a side by side arrangement, a second controller or controller housing for each toggle switch 122, 124 may provided as well. The controllers or controller housings may be staggered along the length of the nozzle 118 or hose 114, one behind the other, to facilitate the use of both hands to control the switches 122, 124 while handling the nozzle. The toggle switches 122, 124 are for controlling the actuator 80 and valve assembly 116, respectively. Electrical wiring or signal cables 126, 128 for the toggles 122, 124, respectively, lead from the nozzle 118 to a control panel or circuit box 130, which may be located on the unit blast unit 20. For the actuator 80, the toggle 122 may be a three-wire switch wherein operating the toggle 122 reverses current flow to reverse the actuator 80. The toggle 122 may be biased so that release of the toggle 122 brings it to a centered or neutral position upon release. The toggle 124 for the valve assembly 116 may be a two-wire switch where the toggle 124 merely performs a cutoff or on/off function. Although the toggle switch 124 is described as a cutoff switch, this may also be configured to provide variable control of the valve assembly 116, such as with the toggle 124. Alternatively, the toggle switch 124 or another switch or control (not shown) provided with the nozzle 118 may be used to regulate a regulator valve (not shown) to regulate the compressed air supplied from the compressor 16 to thus adjust the air pressure to the unit 20.

Electrical power to the actuator, toggles, control panel, valve assembly 116, etc. may be provided from a battery power source (not show) or it may be powered from the generator or power source of the compressor unit 16 or other external power source. Releasable plugs or other couplings may be used to couple the cables 126, 128 to the control panel 130. The cable 88 from the actuator 80 and electrical cable or wiring 134 for the valve assembly 116 may also be plugged or releasably coupled to the control panel 130. Other configurations for wiring of the system may be used as well.

Additionally, where hydraulic or pneumatic actuation is used, the signal cables 126, 128 may be replaced with fluid or air lines. Such hydraulic or pneumatic actuation may be particularly useful in environments, such as around combustible fuels, where electrical sparks or arcing of electrical components may create a hazard. A hydraulic pump or air motor (not shown) may be provided with the system 10 to facilitate operation of such actuation.

In certain applications, control of the blast unit 20 may be provided wirelessly from the nozzle 118, such as through infrared, laser, radio frequency or other wireless signals that may be suitable for remote wireless control. A wireless signal receiver (not shown) may be provided with the unit 20 to thereby actuate the actuator 80 and/or valve 116.

In operation, the blast vessel 24 is filled with a particulate abrasive through the access port 40 and the closure 42 is secured. The particulate abrasive may be sodium bicarbonate (soda or baking soda), sand or other abrasive particulate suitable for performing blasting operations. In many applications, soda is used as the abrasive particulate. The abrasive will tend to collect in the conical lower section 38 of the blast pot 24 so that it is fed towards the opening 106.

The compressor unit 16 provides pressurized air or gas, which has been cooled and dried through dryer unit 22, to the blast unit 20 through inlet conduit 62. Initially, the valve assembly 116 (FIG. 7) and the particulate metering valve 109 may be fully closed. The compressor 16 provides sufficient pressure for the blasting operation. This pressure may vary, but typical pressures are from about 30 psi (206 kPa) to about 180 psi (1241 kPa) or more. All components and fittings of the blast unit should be rated for the particular pressure being used.

To begin blasting, the operator may actuate the valve assembly 116 through toggle switch 124 so that the valve assembly 116 is opened to allow pressurized air to flow from the nozzle 90 to flow through the elbow 104 through the hose 114 and nozzle 118. When the blast unit is pressurized, the central conduit 46 will tend to lift or raise up. Lifting, however, is prevented by the engagement of the drive member 82 with the upper end 74 of the T-fitting 52. Even when the metering valve 109 is fully closed, the pressurized air flow flowing through the hose and nozzle is not significantly affected. The operator may then open the metering valve 109 through toggle switch 122. Upon operation of the toggle switch 122, the actuator 80 will rotate the threaded drive member 82 so that the T-fitting 52 raises, thereby raising the conduit 46 so that the nozzle 90 is raised to open the metering valve 109. The flexible sections 56, 60 of the inlet conduit 62 provide an amount of play to facilitate movement of the T-fitting 52. When the metering valve 109 is opened, soda or other abrasive particulate is drawn into the gap 112 so that the abrasive is delivered through the hose 114 to the nozzle 118, where it may be directed to an object or surface to be blasted. In the embodiment shown, the actuator 80 may only provide about ½ inch (1.27 cm) or less to about 1 inch (2.54 cm) or more of linear movement. This may vary, however, depending upon the metering valve configuration and metered materials employed.

Although one type of blast unit and metering valve is shown, different blast units and metering valves may be used with the remote control system described herein. U.S. Pat. Nos. 2,261,565 and 7,134,945, each of which is incorporated herein in its entirety, describe blasting systems that may be used with the remote actuating system. Additionally, the abrasive metering valve may have a variety of different configurations, such as a ball or ½ turn valves, globe valves, needle valves, etc. One example of a suitable valve for use as the abrasive metering valve is that described in U.S. Pat. No. 6,607,175, which is incorporated by reference in its entirety.

If the amount of abrasive is not suitable, the operator can further open or close the metering valve 109 by means of the toggle 122. The abrasive flow rate may vary, but a typical abrasive flow rate for soda, for example, is about 50 lb/hr to about 100 lb/hr (22.7 kg/hr to 45.4 kg/hr). Pushing the toggle 122 in one direction may cause the actuator 80 to rotate in one direction to close the metering valve 109, while pushing the toggle 122 in the other direction will reverse the actuator rotation to open the metering valve. In one embodiment, the rotary metering valve actuator 80 may provide a constant rate of rotation so that the degree of rotation is controlled through a timed response. Thus, holding the toggle switch 122 down will actuate the actuator for a certain period of time to provide the desired degree of rotation, thus opening or closing the metering valve 109 a selected degree. In another embodiment, the actuator 80 may provide a change of rotation rate that is proportional to or based upon the character of the signal provided from the toggle switch 122. Thus, for example, movement of the toggle 122 only slightly may produce a slow rate of rotation. If the toggle 122 is moved more, a higher rotation rate may be achieved. Thus, the amount of abrasive metered may be performed more slowly or quickly. The same operation may be provided with linear actuators or similar devices.

In the above-described manner, the operator can provide the desired amount of abrasive flow to the nozzle for carrying out the blasting operation without having to return to the blast vessel 24 to adjust the abrasive flow. This saves time, reduces the amount of abrasive that may be wasted and provides on demand the optimal flow of abrasive suitable for the blasting operation.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

I claim:

1. A particulate blasting apparatus comprising:

a blast vessel having an interior for storing abrasive particulate, the blast vessel having an inlet for introducing a pressurized gas into the interior of the blast vessel and an outlet for allowing the passage of the pressurized gas and particulate;

a flexible blast hose coupled at one end to the outlet for directing particulate flow from the outlet;

a blast nozzle coupled to another end of the blast hose;

a metering valve for regulating different amounts of particulate flow from the blast vessel through the outlet;

a flow actuator coupled to the metering valve for actuating the metering valve; and a controller associated with the blast nozzle in communication with the actuator for controlling the actuator from the blast nozzle during blasting operations.

2. The blasting apparatus of claim 1, wherein:

the actuator is at least one of electrically, mechanically, pneumatically and hydraulically operated.

3. The blasting apparatus of claim 1, wherein:

the actuator is wirelessly controlled with the controller.

4. The blasting apparatus of claim 1, wherein:

the actuator rotatably actuates the metering valve.

5. The blasting apparatus of claim 1, wherein:

the actuator actuates the metering valve to provide a different flow rate of particulate without substantially effecting the pressurized gas flow through the outlet.

6. The blasting apparatus of claim 1, wherein:

the metering valve is movable between an open and fully closed position and is coupled to a pressurized gas conduit for directing the pressurized gas to the outlet, and wherein pressurized gas from the conduit is allowed to pass to the outlet when the metering valve is in the fully closed position without substantially effecting the pressurized gas flow to the outlet.

7. A particulate blasting system comprising:

a compressor unit for providing a pressurized gas;

a blast vessel having an interior for storing abrasive particulate, the blast vessel having an inlet for introducing the pressurized gas from the compressor into the interior of the blast vessel and an outlet for allowing the passage of the pressurized gas and particulate;

a flexible blast hose coupled at one end to the outlet for directing particulate flow from the outlet;

a blast nozzle coupled to another end of the blast hose;

a metering valve for regulating different amounts of particulate flow from the blast vessel through the outlet;

a flow actuator coupled to the metering valve for actuating the metering valve; and a controller associated with the blast nozzle in communication with the actuator for controlling the actuator from the blast nozzle during blasting operations.

8. The blasting system of claim 7, wherein:

the compressor provides the pressurized gas at a pressure of from about 30 psi (206 kPa) to about 180 psi (1241 kPa).

9. The blasting system of claim 7, wherein:

the actuator is at least one of electrically, mechanically, pneumatically and hydraulically operated.

10. The blasting system of claim 7, wherein:

the actuator is wirelessly controlled with the controller.

11. The blasting system of claim 7, wherein:

the actuator rotatably actuates the metering valve.

12. The blasting system of claim 7, wherein:

the actuator actuates the metering valve to provide a different flow rate of particulate without substantially effecting the pressurized gas flow through the outlet.

13. The blasting system of claim 7, wherein:

the metering valve is movable between an open and fully closed position and is coupled to a pressurized gas conduit for directing the pressurized gas to the outlet, and wherein pressurized gas from the conduit is allowed to pass to the outlet when the metering valve is in the fully closed position without substantially effecting the pressurized gas flow to the outlet.

14. The blasting system of claim 7, wherein:

the compressor unit and blast vessel are mounted on wheels.

15. A method of blasting an area with an abrasive particulate:

providing a blast vessel having an interior for storing the abrasive particulate, the blast vessel having an inlet for introducing pressurized gas into the interior and an outlet for allowing the passage of the pressurized gas and particulate out of the blast vessel;

introducing a pressurized gas into the inlet of the blast vessel into the interior of the blast vessel;

providing a flexible blast hose coupled at one end to the outlet for directing particulate flow from the outlet and having a blast nozzle coupled to another end of the blast hose, the outlet having a metering valve associated therewith that has a flow actuator for regulating different amounts of particulate flow from the blast vessel through the outlet;

controlling the amount of particulate provided to the blast nozzle from the blast nozzle through a controller associated with the blast nozzle while pressurized gas is flowing through the blast nozzle, the controller being in communication with the actuator for controlling the actuator and the amount of particulate flow through the metering valve; and directing a particulate flow from the blast nozzle to the area.

16. The method of claim 15, wherein:

the actuator actuates the metering valve to provide a different flow rate of particulate without substantially effecting the pressurized gas flow through the outlet.

17. The method of claim 15, wherein:

the metering valve is movable between an open and fully closed position and is coupled to a pressurized gas conduit for directing the pressurized gas to the outlet, and wherein pressurized gas from the conduit is allowed to pass to the outlet when the metering valve is in the fully closed position without substantially effecting the pressurized gas flow to the outlet.

18. The method of claim 16, wherein:

the actuator is wirelessly controlled with the controller.

19. The method of claim 16, wherein:

the actuator rotatably actuates the metering valve.

20. The method of claim 16, wherein:

the abrasive particulate is at least one of sodium bicarbonate and sand.

* * * * *